US005292236A

United States Patent [19]

Graffin

[11] Patent Number: 5,292,236

[45] Date of Patent: Mar. 8, 1994

[54] POSITIVE DISPLACEMENT PUMP WITH PIVOT PISTON VALVE

[75] Inventor: André Graffin, la Chapelle du Bois, France

[73] Assignee: Serac France, La Ferte Bernard, France

[21] Appl. No.: 35,621

[22] Filed: Mar. 23, 1993

[30] Foreign Application Priority Data

Apr. 7, 1992 [FR] France ..... 92 04232

[51] Int. Cl.[5] ..... F04B 21/04

[52] U.S. Cl. ..... 417/510; 417/514; 417/545; 417/549; 417/551

[58] Field of Search ..... 417/510, 514, 520, 545, 417/547, 548, 549, 551

[56] References Cited

U.S. PATENT DOCUMENTS 1,322,552 11/1919 Evans ..... 417/510
1,419,151 6/1922 Kurtz ..... 417/551
2,175,000 10/1939 Schlesinger ..... 417/510
2,231,941 2/1941 Ohman ..... 417/551
3,981,635 9/1976 Hedlund ..... 417/551
4,878,819 11/1989 Bozoyan ..... 417/514

FOREIGN PATENT DOCUMENTS 0093691 4/1983 European Pat. Off. .
3541708 11/1985 Fed. Rep. of Germany .
51973 3/1982 Japan ..... 417/551

*Primary Examiner*—Richard A. Bertsch
*Assistant Examiner*—Roland G. McAndrews, Jr.
*Attorney, Agent, or Firm*—Griffin Butler Whisenhunt & Kurtossy

[57] ABSTRACT

The pump comprises a cylinder delimiting a pumping chamber in which a piston is mounted to slide between an admission orifice and a delivery orifice, the piston including a pumping orifice which is associated with a closure member mounted to pivot about an axis adjacent to the pumping orifice and including a closure face that is substantially plane and that faces the piston.

6 Claims, 2 Drawing Sheets

POSITIVE DISPLACEMENT PUMP WITH PIVOT PISTON VALVE

The present invention relates to a positive displacement pump intended in particular for fitting to a machine for measuring out a heterogeneous substance.

BACKGROUND OF THE INVENTION

Numerous positive displacement pumps are known in which the substance to be measured out comes into contact with one of the sides of a piston that is movably mounted in a cylindrical pump chamber.

In pumps of that type, the other side of the piston is in contact with the ambient medium and there is a major risk of the substance which is being handled becoming contaminated. To mitigate that drawback, it is necessary to provide a bactericide or sterile water on the side of the piston that is contact with the ambient medium, thereby requiring the pump to be relatively complex in structure, in particular at the piston sealing ring, in order to prevent the bactericide or the sterile water passing to that side of the piston which is in contact with the substance to be measured out.

Positive displacement pumps are also known that include an admission opening at one end of the pumping chamber and a delivery opening at an opposite end thereof, the piston then having a pumping opening passing therethrough which is alternately opened and closed by means of a non-return valve. The substance to be packaged then comes into contact with both faces of the piston so that the danger of contamination exists only relative to the piston rod, where such risks are relatively easily contained. Nevertheless, the presence of a non-return valve that is not accessible without disassembling the pump makes the operations of cleaning and sterilizing the pump complex. In addition, because of the non-return valve, the pump can be operated only with liquids that are free from particles and pieces of matter, since they could jam the non-return valve in an open position.

OBJECT AND SUMMARY OF THE INVENTION

An object of the invention is to provide a positive displacement pump that presents a low risk of contaminating the substance it conditions, and that is easy to clean and to sterilize.

According to the present invention, this object is achieved by means of a positive displacement pump comprising a cylinder delimiting a cylindrical pumping chamber having a longitudinal axis and including a feed orifice and a delivery orifice at respective opposite ends, a piston pierced by a pumping orifice and associated with a piston drive rod for causing the piston to slide with reciprocating motion inside the pumping chamber between the feed orifice and the delivery orifice, and a pumping orifice closure device for closing the pumping orifice, wherein the pumping orifice closure device includes a closure member mounted to pivot about an axis adjacent to the pumping orifice and including a closure face that is substantially plane and that faces the piston, and a drive member connected to the closure member, extending outside the cylinder to enable the closure member to be pivoted between a position in which the closure face of the closure member is pressed against the pumping orifice, overlying it in sealed manner, and a position in which the closure face is disengaged from the pumping orifice.

Thus, during pumping, the pumping orifice is alternately opened and closed by acting on the drive member for the closure member such that the substance is conditioned while benefitting from the advantages of the substance coming into contact with both faces of the piston, and during cleaning, the pumping orifice is kept open so that the cleaning and sterilization liquid can be passed at a high rate through the pump so as to clean the pump thoroughly without requiring it to be disassembled.

In an advantageous version of the invention, the drive rod of the piston is mounted to pivot about a pivot axis parallel to the longitudinal axis of the pumping chamber, and the closure member and the drive member of the closure member for closing the pumping orifice are constrained to rotate with the drive rod of the piston. Thus, the piston drive rod serves not only to control the reciprocating motion of the piston inside the pumping chamber by the rod sliding along the longitudinal direction of drive rod, but also to control the closure member by the rod pivoting about its own longitudinal axis.

Preferably, the piston drive rod is disposed eccentrically relative to the piston. Thus, during pivoting of the piston drive rod, rotation of the piston itself is prevented without it being necessary to provide a special member for this purpose.

According to another advantageous aspect of the invention, the piston drive rod is mounted to slide axially on a pivot stud carried by the piston, and the closure member is rigidly fixed to the drive rod and is held pressed against the piston by a resilient thrust member supported by the piston. Preferably, the resilient thrust member includes an abutment, and the closure member includes a cavity of sufficient depth to enable the piston to move relative to the closure member along the axial direction of the drive rod when the cavity of the closure member faces the resilient thrust member. In this way, the closure member is normally pressed in sealed manner against the facing surface of the piston, but when the cavity of the closure member faces the resilient thrust member, it comes into abutment and the axial motion to which the piston may be subjected relative to the closure member then makes it possible to space apart the closure member of the piston and to ensure that the closure member is cleaned and sterilized on all of its faces.

BRIEF DESCRIPTION OF THE DRAWINGS

Other features and advantages of the invention appear on reading the following description of particular non-limiting embodiments of the invention described with reference to the accompanying drawings, in which.

MORE DETAILED DESCRIPTION

Figure 1:
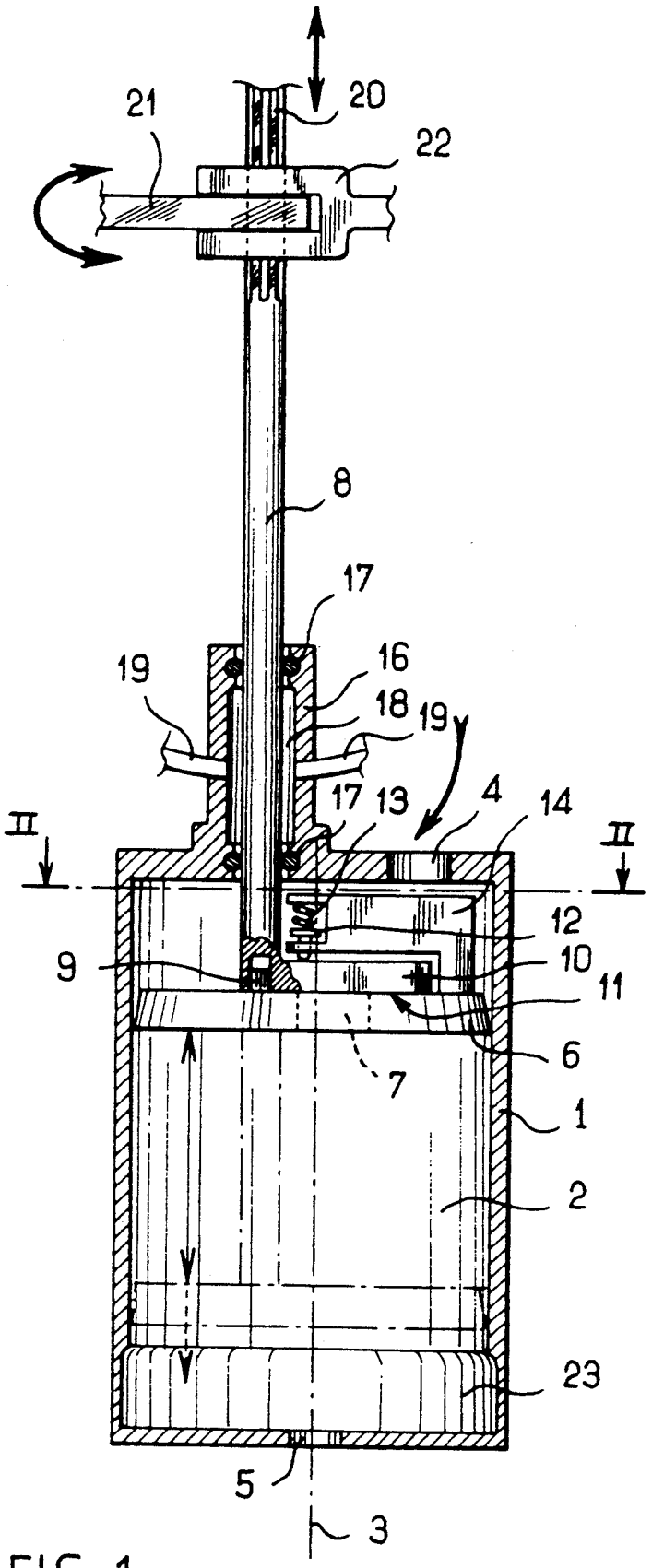
FIG. 1 is a diagrammatic elevation view of a pump of the invention, with its cylinder being shown in section on an axial plane.

With reference to the figures, a positive displacement pump of the invention comprises a cylinder 1 delimiting a cylindrical pumping chamber 2 having a longitudinal axis 3 and including a feed orifice 4 and a delivery orifice 5 at opposite ends thereof. A piston 6 pierced by a pumping orifice 7 is disposed to slide with reciprocating motion inside the pumping chamber 2 between the feed orifice 4 and the delivery orifice 5.

The position of the piston 6 is controlled by a drive rod 8 whose bottom end is pivotally mounted on a pivot stud 9 fixed on the top face of the piston 6 in a position that is eccentric thereon. A closure member 10 in the form of a blade in the embodiment shown is secured to the drive rod 8. The closure member 10 has a substantially plane bottom closure face 11 facing the piston 6 and pressed against the top face of the piston 6 by a thrust member 12 in the form of a stud having a flange which is subjected to resilient bias by a spring 13 so as to bear against the closure member 10. The thrust member 12 is carried by a bracket 14 fixed to the piston 6. In addition, the closure member 10 includes a cavity 15 in its face facing the thrust member 12, said cavity being, in the present invention, in the form of a groove whose bottom slopes towards the edge of the closure member 10 and which comes to face the thrust member 12 when the closure member 10 is pivoted in a manner explained in greater detail below.

The drive rod 8 passes through the cylinder 1 by passing through a guide ring 16. When the pump is to be used for conditioning operations in sterile surroundings, the guide ring 16 includes sealing rings 17 as shown in FIG. 1 for defining an annular chamber 18 that is swept by steam or sterile water applied to the annular chamber 18 via feed and exhaust ducts 19.

The top of the drive rod 8 includes a fluted portion 20 on which a drive member 21 is engaged that includes complementary fluting for driving the drive rod 8 with pivoting motion about the pivoting stud 9 when the drive member 21 is moved by a control member such as a pneumatic actuator (not shown). To avoid the drive member 21 being subjected to axial displacement, it is preferably associated in a fork 22 which is secured to the cylinder of the pump. In addition, the drive rod 8 is associated with a control member (not shown) such as a pneumatic actuator, for the purpose of displacing it along its longitudinal axis with reciprocating motion for the purpose of moving the piston 6 back and forth inside the cylindrical pump chamber 2.

Figure 2:
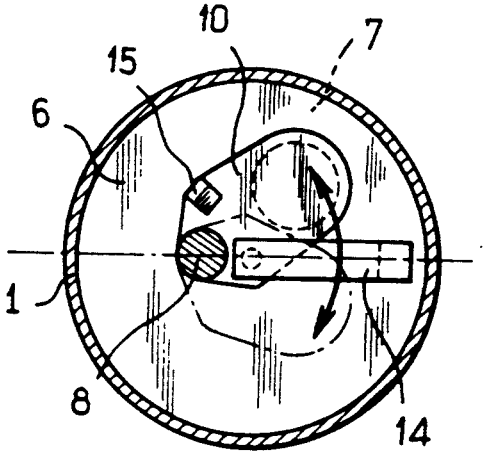
FIG. 2 is a section view on II—II of FIG. 1.

The pump of the operation operates as follows: with the piston 6 raised to its high position as shown in FIG. 1 by appropriate displacement of its drive rod 8, the drive member 21 is controlled to cause the closure member 10 to overlie the pumping orifice 7 as shown in solid lines in FIG. 2. The drive rod 8 is then caused to move the piston 6 downwards so that the substance to be conditioned is sucked in through the feed orifice 4, until the piston 6 reaches a low position as shown in fine lines in FIG. 1. The drive member 21 is then controlled to cause the closure member 10 to pivot as shown by fine chain-dotted lines in FIG. 2, thereby opening the pumping orifice 7. The drive rod 8 is then controlled to raise the piston 6 and the substance to be conditioned passes through the pumping orifice 7 to come beneath the piston 6 so that on the following pump stroke, a determined quantity of substance corresponding to the volume swept by the piston is forced through the delivery orifice 5. Naturally, on starting, the pump is driven several times in order to fill up the bottom portion of the cylinder 1 and the delivery ducting (not shown). In addition, feed lines and delivery lines are provided for the pump, together with conventional means such as controlled valves to prevent the substance to be conditioned moving in the reverse direction to that which is desired.

Figure 3:
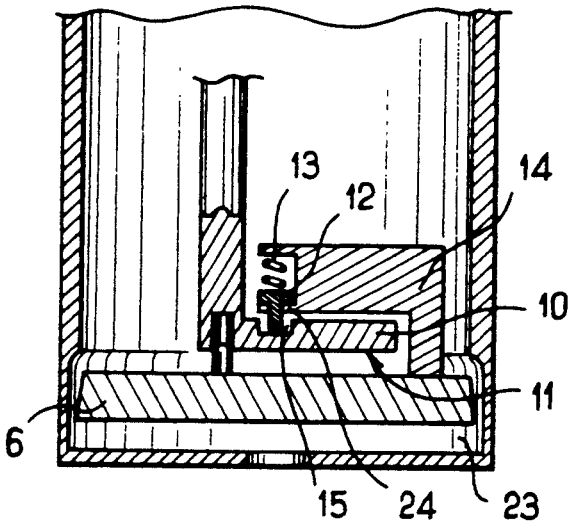
FIG. 3 is a fragmentary view of the FIG. 1 pump in a cleaning position, in section on line III—III of FIG. 4.
Figure 4:
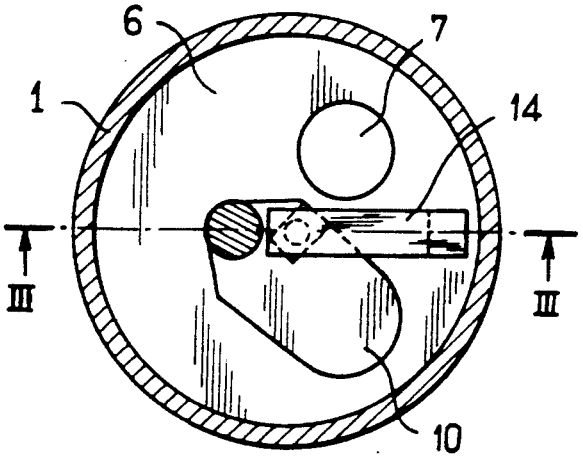
FIG. 4 is a section view analogous to that of FIG. 2, but for the pump in a cleaning position.
Figure 6:
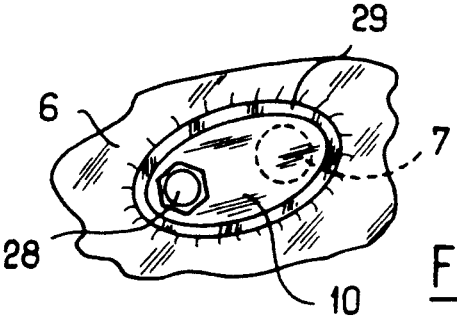
FIG. 6 is a plan view of the device shown in FIG. 5.

When it is desired to clean the pump, and possibly also to sterilize it, the piston 6 is brought to its lowermost position in a portion 23 of the cylinder having an inside diameter that is greater than the diameter of the piston 6. This position is shown in FIG. 3. Simultaneously, the closure member 10 is pivoted so that the cavity 15 of the closure member 10 faces the thrust member 12 as shown in FIG. 4. The thrust member 12 then comes into contact with an abutment 24 formed by the bottom edge of the bracket 14 such that the distance between the bottom end of the thrust member and the top face of the piston is greater than the thickness of the piston in the cavity 15. Cleaning and sterilization fluid is delivered via the feed orifice 4 and runs through the pumping orifice 7 and all around the piston 6. The pressure of the cleaning liquid also causes the piston 6 to move downwards relative to the closure member 10 until the bottom end of the thrust member 12 is in contact with the bottom of the groove 15 as shown in FIG. 3. The bottom face 11 of the closure member 10 is then spaced apart from the top face of the piston 6, thus allowing cleaning fluid to pass between the closure member 10 and the top face of the piston 6. The entire pump is thus subjected to the flow of cleaning fluid without there being any need to disassemble it.

Figure 5:
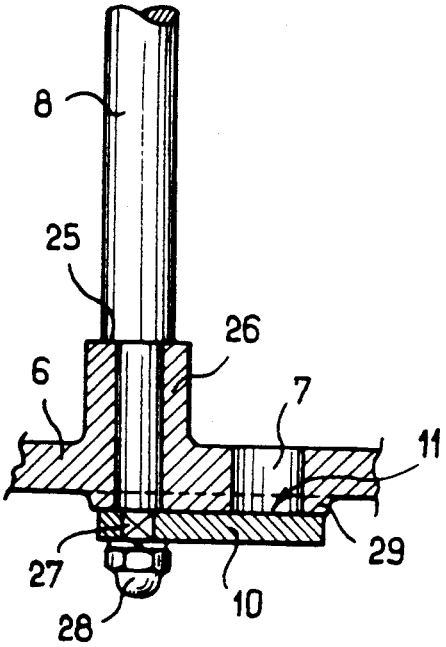
FIG. 5 is a fragmentary section view of a variant embodiment of the invention.

FIG. 5 shows a variant embodiment in which the drive rod 8 includes a shoulder 25 bearing against the top end of a sleeve 26 secured to the piston 6. The closure member 10 is disposed, in this case, beneath the piston 6 and it is driven by the drive rod 8 via a square section portion 27 on which the closure member 10 is secured by a nut 28. Unlike the preceding embodiment, the closure member 10 is thus not capable of performing axial movement relative to the piston 6, and in order to clean the closure face 11 of the closure member 10 properly, i.e. its face facing the piston 6, the piston 6 includes a region of increased thickness 29 surrounding the pumping orifice and the pivot axis of the drive rod 8. Thus, when the closure member 10 overlies the pumping orifice 7, as shown in FIG. 5, the closure member 10 provides sealed closure for the pumping orifice 7. In contrast, when the closure member 10 is moved away from the pumping orifice 7, it is simultaneously moved away from the region of greater thickness 29 such that during cleaning, cleaning fluid can flow between the closure face 11 and the bottom face of the piston 6.

The invention is naturally not limited to the embodiments described and variants can be applied thereto without going beyond the ambit of the invention.

In particular, although the preferred embodiment shown has a control rod 8 for the piston 6 that serves simultaneously to pivot the closure member 10, it is possible to make a pump having an independent drive rod for the closure member 10.

When conditioning must be sterile, it is also advantageous to provide a bellows around the drive rod 8 over a length that is not less than the stroke of the piston 6 so as to minimize the introduction of polluting dust into the pump.

In the embodiment of FIG. 5, a region of greater thickness 29 is shown that extends continuously between the pumping orifice 7 and the pivot axis of the drive rod 8. It would naturally be possible to provide two separate regions of greater thickness forming a rim of uniform thickness around the drive rod 8 and around the pumping orifice 7 so as to minimize friction between the closure member 10 and the face of the piston 6.

Although the above description relates to the drive rod 8 and the drive member 21 being actuated by pneumatic actuators, it is also possible for these members to be controlled by cams, in particular when the pump of the invention is fitted to each of the stations in a carousel, with the members of the various pumps being fitted with cam follower wheels that all co-operate with the same stationary cams.

Although the invention has been described for a pumping chamber that is circular in section, a pump of the invention can be implemented with a pumping chamber of non-circular section, e.g. of oval or elliptical section. Under such circumstances, there is no longer any danger of the piston rotating about the longitudinal axis of the pump chamber, so the drive rod 8 can then be disposed on the axis of the pumping chamber.

I claim:

1. A positive displacement pump comprising a cylinder delimiting a cylindrical pumping chamber having a longitudinal axis and including a feed orifice and a delivery orifice at respective opposite ends, a piston pierced by a pumping orifice and associated with a piston drive rod for causing the piston to slide with reciprocating motion inside the pumping chamber between the feed orifice and the delivery orifice, and a pumping orifice closure device for closing the pumping orifice, wherein the pumping orifice closure device includes a closure member mounted to pivot about an axis which is adjacent to the pumping orifice and extends in a direction parallel to said longitudinal axis of said cylindrical pumping chamber, said closure member including a closure face that is substantially plane and that faces the piston, said pumping orifice closure device also including a drive member connected to the closure member, extending outside the cylinder to enable the closure member to be pivoted between a position in which the closure face of the closure member is pressed against the pumping orifice, overlying it in sealed manner, and a position in which the closure face is disengaged from the pumping orifice.

2. A positive displacement pump according to claim 1, wherein the piston drive rod is mounted to pivot about a pivot axis parallel to the longitudinal axis of the pumping chamber, and wherein the closure member and the drive member of the closure member for closing the pumping orifice are constrained to rotate with the piston drive rod.

3. A positive displacement pump according to claim 2, wherein the piston drive rod is disposed eccentrically relative to the piston.

4. A positive displacement pump according to claim 2, wherein the piston includes a region of increased thickness surrounding the pumping orifice and the pivot axis of the drive rod.

5. A positive displacement pump according to claim 2, wherein the piston drive rod is mounted to slide axially on a pivot stud carried by the piston, and wherein the closure member is rigidly fixed to the piston drive rod and is held pressed against the piston by a resilient thrust member supported by the piston.

6. A positive displacement pump according to claim 5, wherein the resilient thrust member includes an abutment, and wherein the closure member includes a cavity of sufficient depth to enable the piston to move relative to the closure member along the axial direction of the drive rod when the cavity of the closure member faces the resilient thrust member.

* * * * *